United States Patent [19]

Reitter

[11] Patent Number: 4,796,453

[45] Date of Patent: Jan. 10, 1989

[54] HYDRAULIC ELEMENT AND DRAWING DIE ASSEMBLY

[75] Inventor: Erhardt Reitter, Sulzfeld, Fed. Rep. of Germany

[73] Assignee: Karl Hehl, Lossburg, Fed. Rep. of Germany

[21] Appl. No.: 63,327

[22] Filed: Jun. 18, 1987

[30] Foreign Application Priority Data

Jun. 21, 1986 [DE] Fed. Rep. of Germany ..... 3620876

[51] Int. Cl.[4] ..... B21D 24/02; B21D 24/14

[52] U.S. Cl. ..... 72/347; 72/350

[58] Field of Search ..... 72/148, 347, 350, 351, 72/354, 358, 359

[56] References Cited

U.S. PATENT DOCUMENTS

| | | | |
|---|---|---|---|
| 3,751,962 | 8/1973 | Cvacho et al. | 72/347 |
| 4,363,232 | 12/1982 | Reitter | 72/350 |
| 4,530,224 | 7/1985 | Hild et al. | 72/148 |

FOREIGN PATENT DOCUMENTS

| | | | |
|---|---|---|---|
| 132028 | 10/1947 | Australia | 72/350 |
| 3333687 | 3/1985 | Fed. Rep. of Germany | 72/350 |

*Primary Examiner*—E. Michael Combs
*Attorney, Agent, or Firm*—Spencer & Frank

[57] ABSTRACT

A hydraulic element including a working cylinder defining a cylinder chamber having an axis and containing hydraulic medium, a working piston movable in the cylinder chamber along the axis and having an interior end arranged to communicate with the hydraulic medium in the cylinder chamber, and an annular piston movable in the cylinder chamber, along the axis, and enclosing the working piston, the annular piston having an interior end communicating with the hydraulic medium in the cylinder chamber so that movement of one of the pistons in a first direction along the axis causes the other of the pistons to move in a second direction opposite to the first direction.

8 Claims, 3 Drawing Sheets

FIG. 3b
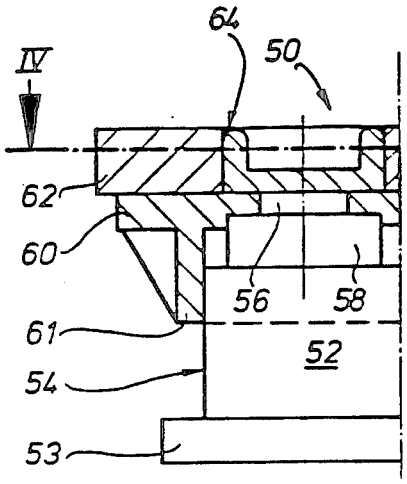
FIG. 3a
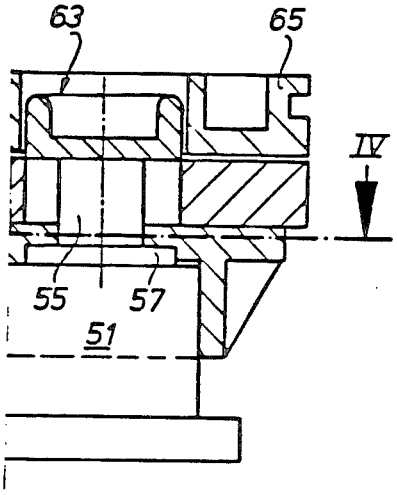
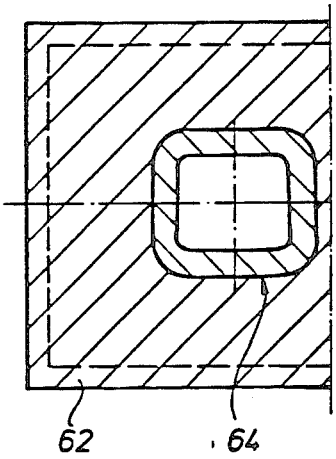
FIG. 4b
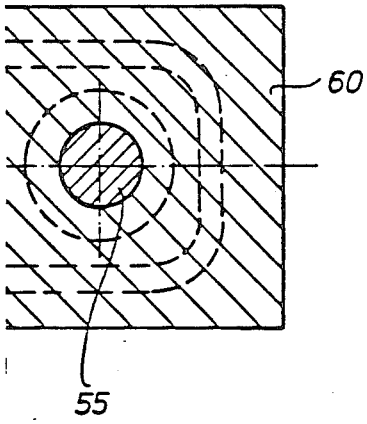
FIG. 4a

HYDRAULIC ELEMENT AND DRAWING DIE ASSEMBLY

BACKGROUND OF THE INVENTION

1. Field of the Invention

The invention relates to a hydraulic element designed especially for assembling a drawing die with a blank holder and a shaping rim movable in relation to it, the hydraulic element being composed of working piston housed inside a working cylinder so as to be axially movable and so as to be acted on from the back by fluid pressure. The invention further relates to a drawing tool incorporating such a hydraulic element.

2. Discussion of the Prior Art

FRG-OS No. 34 24 262 discloses a drawing die having a drawing die cushion and composed of several pressure cylinders acted on by a hydraulic medium, with pistons being axially movable within the cylinders, for the support of a blank holder, and a further drawing die cushion holding a drawing punch movable in the drawing direction and having at least one pressure cylinder connected by passages to the pressure cylinders of the drawing die cushion supporting the blank holder and acted on by a hydraulic medium to be displaced relative to these pressure cylinders during the drawing operation, with a piston being disposed inside the pressure cylinder.

In the known drawing die, several additional pressure cylinders are thus assigned to a pressure cylinder supporting the movable drawing punch, and the blank holder that encloses the drawing punch rests on the pressure cylinders. It is characteristic here that during the downward travel of a drawing ring activated, for example, by an extrusion ram, the hydraulic medium escaping from the pressure cylinders of the drawing die cushion flows through suitable passages into the pressure cylinder of the further drawing die cushion and acts on a piston guided in the pressure cylinder, the piston in turn drives the drawing punch during the drawing operation in the drawing direction, opposite to the direction of travel of the drawing ring and consequently of the blank holder. This arrangement thus permits the execution of complex movements in opposite direction to the pull transmitted by the descending drawing ring and, similarly, the division of the desired drawing depth into partial drawings effected respectively by the descending drawing ring and by the ascending drawing punch.

In addition to these technical drawing possibilities there is a particular advantage to the known arrangement and also to the utilization of the pressure energy in the hydraulic medium displaced from the pressure cylinder supporting the blank holder by the downward travel of the drawing ring and the associated downward travel of the blank holder to drive the drawing punch in the direction opposite to the travel of the drawing ring.

The drawing technology made possible by this known arrangement has proven its usefulness. However, there is still need to improve the known arrangement with regard to simplicity and, above all, cost-effectiveness.

SUMMARY OF THE INVENTION

Accordingly, an object of the present invention is to provide a hydraulic element especially for assembling a drawing die with a blank holder and a deformation outline movable in relation to it, which permits the benefits made possible by the known arrangement but is appreciably simpler and more cost-effective.

It is a further object of the invention to create a drawing die assembled by means of such a hydraulic element.

With respect to the hydraulic element, the above and other objects of the invention are achieved, in a hydraulic element including a working cylinder defining a cylinder chamber having an axis and containing hydraulic medium and a working piston movable in the cylinder chamber along the axis and having an interior end arranged to communicate with the hydraulic medium in the cylinder chamber, by the improvement wherein the element further comprises an annular piston movable in the cylinder chamber, along the axis, and enclosing the working piston, the annular piston having an interior end communicating with the hydraulic medium in the cylinder chamber so that movement of one of the pistons in a first direction along the axis causes the other of the pistons to move in a second direction opposite to the first direction.

Thus, one feature of a hydraulic element according to the invention is that two pistons moving in mutually opposite directions are housed coaxially inside a working cylinder, adjustment by means of the hydraulic charge being such that the annular piston is in its fully extended position when the working piston is fully retracted or, inversely, the working piston is in its fully extended position when the annular piston is fully retracted. When one piston moves from its fully extended position toward its retracted position, pressure fluid displaced from the hydraulic charge acts from the rear on the other piston in the working cylinder and thereby drives it in the direction opposite to that of the first piston.

The hydraulic element of the invention differs from the state-of-the-art device described above, inter alia, by its highly compact design.

According to an advantageous embodiment, the working piston of the hydraulic element is designed as a differential piston with a differential surface that can be acted on by fluid pressure, which surface faces away from the hydraulic pressure acting on the interior end of the differential piston, so that action on this differential surface by hydraulic pressure will return the working piston from its extended position.

Another advantageous embodiment of the hydraulic element of the invention provides that the working piston configured as a differential piston presents a central cylindrical recess, that a cylindrical extension coaxial with the working cylinder extends from a base plate to which it is firmly connected and which closes it from the back, the extension presenting a head that engages in the working piston's central cylindrical recess, and an annular portion of the working piston concentrically surrounding the cylindrical extension forms the working piston's differential surface which can be acted on by hydraulic pressure in a differential chamber between the annular portion and the head of the cylindrical extension.

A further improvement of the last-cited embodiment provides that the central recess in the working piston is terminated at the end away from the base plate by a piston head and the latter can be acted on by fluid pressure through at least one passage that extends from the pressure chamber at the rear of the working cylinder to a pressure chamber formed between the piston head and the head of the cylindrical extension.

Incorporation of the piston head into the impact surface of the working piston results in a highly compact design. The impact surfaces of the working piston and of the annular piston arranged coaxially to the working piston can be selected in accordance with the particular purpose intended for the hydraulic element. But it has proven advantageous for the surface of the working piston acted on by hydraulic pressure in the work direction to be about equal to the rear pressure surface of the annular cylinder housed in the working cylinder coaxially to the working piston. The result is that the annular cylinder and the working cylinder can absorb identical forces and execute equal but opposite movements that are a function of magnitude.

It is within the scope of the invention for the hydraulic element to have at least two working cylinders with parallel axes, each with a working piston and an annular piston coaxial thereto, and the working cylinders can be housed in a common cylinder block.

A drawing die which includes a hydraulic element according to the invention is characterized in that the drawing punch of the drawing die is mounted on the working piston of the hydraulic element, while the blank holder surrounding the drawing punch rests on the annular piston arranged coaxially to the working piston.

The compact design of the hydraulic element used thus results also in a highly compact and advantageous design for the drawing die. The blank holder of the drawing die mounted on the annular piston can usefully feature a guide section which encloses the working cylinder or a cylinder block housing the latter, ensuring precise guidance for the blank holder.

One embodiment of the drawing die includes a blank holder resting on the annular pistons of two working cylinders arranged with parallel axes separated by a certain distance, and a drawing punch mounted on working pistons being capable of movement in a direction opposite to that of the annular piston. Such a design is specially recommended for a tool intended for the drawing of double sinks.

In such a tool, it has proven useful if the blank holder is mounted on a pressure distribution plate located at the working cylinders or a cylinder block housing the latter and resting on the annular piston, openings for the working pistons extending through the plate coaxially with the working cylinders holding the tool's drawing punches.

The attached drawings illustrate one embodiment of the hydraulic element of the invention and two drawing dies assembled by using the hydraulic element.

BRIEF DESCRIPTION OF THE DRAWING

FIGS. 3*a* and 3*b* are views similar to FIGS. 2*a* and 2*b* of a drawing die for the drawing of double sinks with a hydraulic element having two working cylinders arranged with parallel axes at a certain distance from each other, the cylinders being housed in a cylinder block shown in side view.

FIGS. 4*a* and 4*b* show the tool of FIGS. 3*a* and 3*b* in a partial cross-sectional view along line IV—IV shown in FIGS. 3.

DESCRIPTION OF THE PREFERRED EMBODIMENTS

Figure 1A:
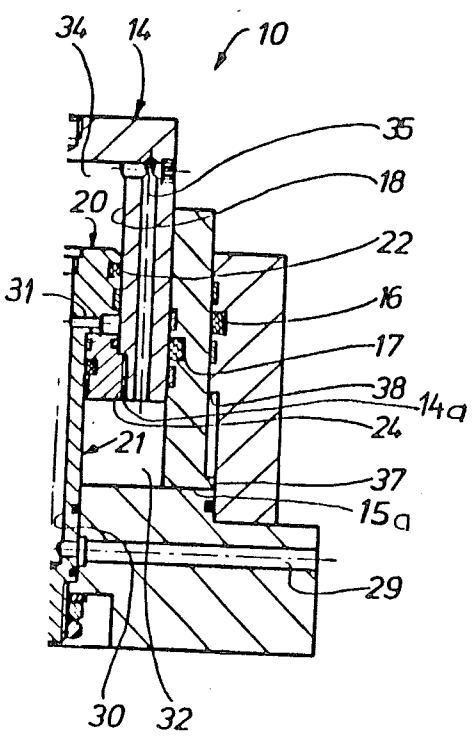
FIGS. 1*a* and 1*b* show respective halves, in cross-section, of a hydraulic element with two pistons arranged coaxially in a working cylinder so as to be movable in opposite directions, each FIG. showing a respective end position of the pistons.
Figure 1B:
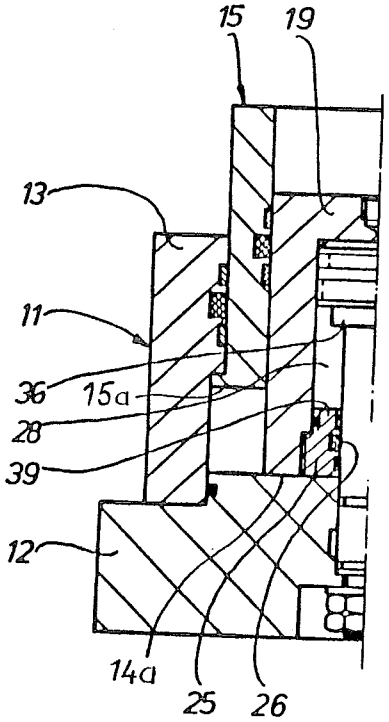

Hydraulic element 10, shown separately in FIGS. 1*a* and 1*b*, has a working cylinder 11, a central working piston 14 and an annular piston 15 surrounding piston 14. Working cylinder 11 is composed of a base plate 12 and a cylinder housing 13 mounted on the latter. Pistons 14 and 15 are arranged coaxially so as to be movable in respectively opposite directions.

Annular piston 15 is sealed against cylinder housing 13 by means of 0 ring seals 16 arranged in annular grooves of cylinder housing 13, and central working piston 14 is sealed against annular piston 15 by means of 0 ring seals 17 arranged in annular grooves of annular piston 15.

From the side facing base plate 12, central piston 14 has a central cylindrical recess 18 defining a central working chamber 34 closed at the end away from base plate 12 by piston head 19. A cylindrical extension 21 carried by plate 12 has a piston-shaped head 20 which fits into central cylindrical recess 18. Cylindrical extension 21 extends coaxially with respect to piston 14 from base plate 12 and has a smaller diameter than head 20. Head 20 is sealed in relation to the wall of central cylindrical recess 18 by O ring seals 22 arranged in annular grooves in head 20.

The open side of central cylindrical recess 18 is terminated by an annular element 25 screwed into a thread 24. Annular element 25 in turn surrounds cylindrical extension 21 and a fluid-tight seal is created therebetween by O ring seals 26 engaged in annular grooves. An annular pressure chamber 28 is formed between annular element 25 and piston-shaped head 20 of extension 21, pressurization of chamber 28 by a hydraulic medium being possible via passages 29 and 30 and a further radial passage, that extend through base plate 12 and cylindrical extension 21.

A pressure chamber 32 is formed between the bottom of working piston 14 and base plate 12 and communicates with chamber 34 by a closable passage 35 which extends through the side wall of working piston 14.

In keeping with their role, central working piston 14 and enclosing concentric annular piston 15 travel in respectively opposite axial directions within working cylinder 11. Accordingly, working cylinder 11 receives a hydraulic working medium which acts on the lower end of annular piston 15 and pressurizes the bottom of central working piston 14, i.e. the end facing base plate 12, as well as the side of piston head 19 facing head 20 of cylindrical extension 21.

In hydraulic element 10 shown here, the rear pressure surface 14*a* of working piston 14, which extends and includes the rear surface of annular element 25, has the same area as the back 15*a* of annular piston 15.

If flow channel 35 is closed, for example by a plug, the hydraulic force, or deformation force, which acts on working piston 14, is as high as the blank holding force with which annular piston 15 is moved axially downwardly. In special cases, it may be necessary, because of the characteristics of the material of blank 45 to be deformed or the characteristics of the specific drawing die, to make the mentioned hydraulic force acting on working piston 14 greater or less than the force with which annular piston 15 is moved axially.

The mentioned hydraulic, or deformation, force is significantly greater if, with flow channel 35 open, piston head 19 is additionally charged with a pressure load via chamber 34.

The arrangement is such that, as shown in FIG. 1*a*, working piston 14 is at its limit position, determined by annular element 25 bearing against stop 36 of cylindrical extension 21, when annular piston 15 is in its completely retracted position, in which the bottom of piston 15 abuts base plate 12.

Inversely, as shown in FIG. 1*b*, the bottom of working piston 14 abuts base plate 12 when annular piston 15 is in its maximum extended position, in which the annular stop 37 of piston 15 has run up against an internal annular shoulder 38 of cylinder housing 13 acting as a stop.

Ordinarily, annular piston 15 is moved to its retracted position, toward base plate 12, by a force applied by a component external to element 10 and forming part of the device into which element 10 is incorporated.

An axial shift of annular piston 15 from its fully extended position (FIG. 1*b*) toward base plate 12 (FIG. 1*a*)—accompanied by displacement of the hydraulic medium applying pressure to the bottom 15*a* of annular piston 15 - causes corresponding pressure on the bottom of working piston 14 and, via passage 35 on piston head 19 and thus a shifting of working piston 14 to a position away from base plate 12. Working piston 14 can be returned from the position within the working cylinder away from base plate 12 (FIG. 1*a*), by pressure on differential surface 39 of annular element 25 facing head 20, by hydraulic fluid supplied to differential surface 39 via passages 29, 30 and 31 extending through base plate 12 and cylindrical extension 21.

Figure 2A:
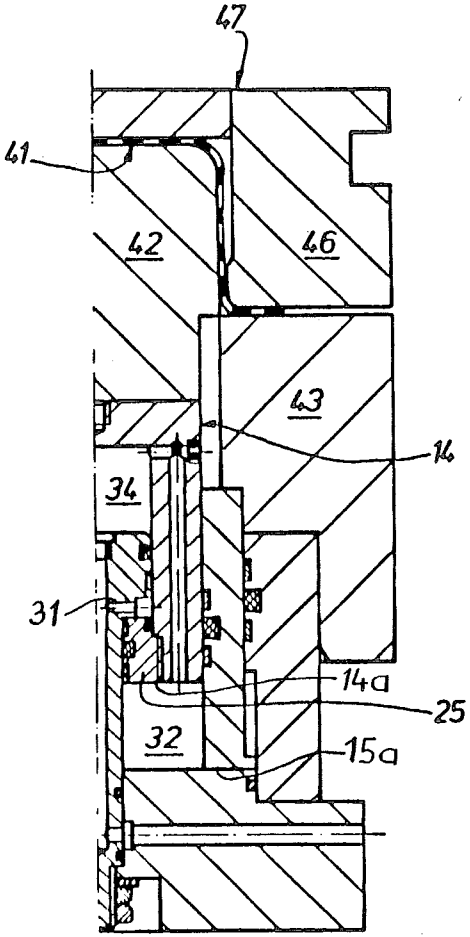
FIGS. 2*a* and 2*b* show half cross-sections in two different operating positions of a drawing die assembled by means of a hydraulic element as in FIGS. 1*a* and 1*b*.
Figure 2B:
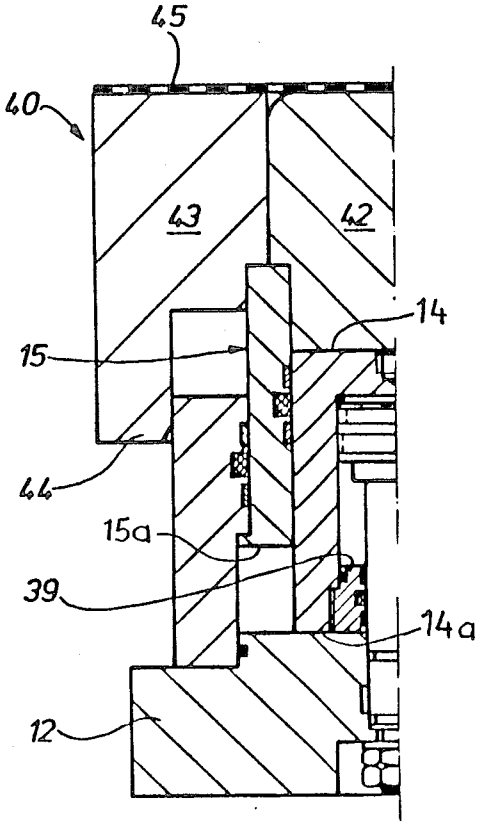

FIGS. 2*a* and 2*b* show a drawing die 40 assembled by using hydraulic element 10 of FIGS. 1 for the production of a can-shaped deep-drawn part 41. In this drawing die, drawing punch 42 is firmly mounted on central working piston 14 and is surrounded by a blank holder 43 which rests on enclosing concentric annular piston 15. Blank holder 43 has a guiding portion 44 extending toward the working cylinder base plate 12 and surrounding cylinder housing 13.

In FIG. 2*b*, blank holder 43 and drawing punch 42 are in an initial position indicating the start of a drawing operation in which blank 45 is placed on parts 42 and 43. In this operating position, annular piston 15 supporting blank holder 43 is in its maximum extended position, while working piston 14 holding drawing punch 42 is in its retracted position. If drawing ring 46 of upper die portion 47, shown in FIG. 2*a*, descends on blank holder 43, the drawing operation starts in such a manner that, blank 45 being clamped between draw ring 46 and blank holder 43, the blank holder and thus annular piston 15 supporting it are moved in the direction toward base plate 12. As a result, working piston 14 is acted on by the hydraulic medium displaced in chamber 32 by annular piston 15 and punch 42 is driven in the direction opposite that of annular piston 15. Accordingly, drawing punch 42 is subjected to a thrust opposite to the direction of travel of blank holder 43, so that the drawing operation breaks down into a partial stroke executed by the blank holder and a partial stroke in the opposite direction by the drawing punch.

FIG. 2*a* shows the operating position at the end of the drawing operation, in which can-shaped deep-drawn part 41 is formed and a peripheral rim flange of the deep-drawn part is still held between drawing ring 46 and blank holder 43. In this operating position, annular piston 15 abuts base plate 12, while working piston 14 is in its maximum extension position limited by stop 36 of cylindrical extension 21. The thrust of working piston 14 is effected by simultaneous pressure on the bottom of the working piston, facing base plate 12 and on piston head 19 via closable passage 35.

Return of the drawing die, i.e. parts 42 and 43, to its initial position is effected by simultaneously raising part 43 and upper die portion 47. For this purpose, hydraulic medium is introduced via passages 29 and 30 into chamber 28 to drive piston 14 downwardly and piston 15 upwardly.

The design-determined preset ratio between blank holding force and deformation force can be changed in a simple manner in the hydraulic element of the invention by programmed action during the drawing operation of fluid pressure on differential surface 39 of annular element 25.

This programmed action during the drawing operation can be effected by limiting the outflow of hydraulic medium from pressure chamber 28, required during the drawing operation, to a greater or lesser extent by means of a choke valve in passage 29 or 30.

Tool 50 shown in FIGS. 3 and 4 is a drawing die for the production of double sinks. Accordingly, two working cylinders 51 and 52 are arranged with their axes parallel and laterally spaced from each other. Cylinders 51 and 52 are incorporated into a single cylinder body 54 held by a base plate 53. Within each cylinder 51, 52 is a working piston 55, 56 enclosed by an annular piston 57, 58. The pistons cooperate with one another with reference to FIGS. 1 and 2. Annular pistons 57, 58 support a common distribution plate 60 which has a guide portion 61 surrounding cylinder block 54 and on top of which is held a common blank holder 62.

Central working pistons 55, 56 extend through respective openings in pressure distribution plate 60, and hold respective drawing punches 63, 64 corresponding to the basin shapes.

FIG. 3*b* shows the tool in the starting position in which drawing punches 63 and 64 and blank holder 62 are in the same plane. In this operating position, annular pistons 57, 58 are at maximum extension, while working pistons 55, 56, are at their bottom limit positions. When, as shown in FIG. 3*a* blank holder 62 is lowered in response to downward movement of drawing ring 65, annular pistons 57, 58 displace the hydraulic medium in the working cylinders, which leads to corresponding pressure on the bottoms of central working pistons 55, 56 and thus to driving of drawing punches 63, 64 in the direction opposite to that of blank holder 62.

The invention now being fully described, it will be apparent to one of ordinary skill in the art that many changes and modifications can be made thereto without departing from the spirit or scope of the invention as set forth herein.

The present disclosure relates to the subject matter disclosed in German Application P No. 36 20 876.0 of June 21, 1986, the entire specification of which is incorporated herein by reference.

What is claimed:

1. In a hydraulic element including a working cylinder defining a cylinder chamber having an axis and containing hydraulic medium and a working piston movable in the cylinder chamber along the axis and having an interior end arrange to communicate with the hydraulic medium in the cylinder chamber, the improvement wherein said element further comprises an annular piston movable in said cylinder chamber, along the axis, and enclosing said working piston, said annular piston having an interior end communicating with the hydraulic medium in said cylinder chamber so that movement of one of said pistons in a first direction along the axis causes the other of said pistons to move in a second direction opposite to the first direction and wherein said working piston is a differential piston having a differential surface, said working piston has a hollow interior extending from said interior end and comprises an annular part extending radially inwardly and carrying said differential surface, and said element further comprises: a base plate supporting said working cylinder and facing said interior end of said working piston; a cylindrical extension piece secured to said base plate, extending into said hollow interior of said working piston, and being in sliding contact with said annular part; and a head member carried by said extension piece and disposed in said hollow interior such that a first portion of said hollow interior lies between said head and said annular part and forms a differential chamber for receiving hydraulic fluid which acts on said working piston in opposition to the hydraulic medium in said cylinder chamber.

2. A hydraulic element as defined in claim 1 wherein said working piston further has a piston head located at the end of said working piston remote from said interior end and closing said hollow interior of said working piston such that a second portion of said hollow interior lies between said piston head and said head member and defines a pressure chamber, and said working piston is provided with a fluid passage establishing fluid communication between said cylinder chamber and said pressure chamber.

3. A hydraulic element as defined in claim 1 wherein said annular piston has a working surface communicating with said cylinder chamber and having an area at least approximately equal to the area of said interior end of said working piston.

4. A hydraulic element as defined in claim 1, further comprising a drawing punch secured to said working piston; and a blank holder surrounding said drawing punch and resting on said annular piston.

5. A hydraulic element as defined in claim 1, wherein an annular pressure chamber is formed between said differential piston and said head member, said hydraulic element further comprising: means defining a fluid conduit for supplying hydraulic medium to said annular pressure chamber wherein said fluid conduit extends through said base plate and said extension piece.

6. A hydraulic element as defined in claim 5, further comprising a choke valve positioned in said fluid conduit defining means for effecting the drawing operation by limiting the overflow of hydraulic medium from said pressure chamber.

7. A drawing die comprising:

a plurality of hydraulic elements, each of said hydraulic elements comprising: a working cylinder defining a cylinder chamber having an axis and containing hydraulic medium and a working piston movable in the cylinder chamber along the axis and having an interior end arranged to communicate with the hydraulic medium in the cylinder chamber, said element further comprises an annular piston movable in said cylinder chamber, along the axis, and enclosing said working piston, said annular piston having an interior end communicating with the hydraulic medium in said cylinder chamber so that movement of one of said pistons in a first direction along the axis causes the other of said pistons to move in a second direction opposite to the first direction, wherein said hydraulic elements have parallel cylinder chamber axes; and said die further comprises drawing punches secured to said working pistons; a blank holder surrounding said drawing punches and resting on said annular pistons; and a pressure distribution plate which holds said blank holder, is guided by said working cylinders, rests on said annular pistons, and is provided with passages through which said working pistons extend.

8. A drawing die as defined in claim 7 wherein said blank holder includes a guide position which surrounds said working cylinders.

* * * * *